US007611213B2

(12) United States Patent
Wu et al.

(10) Patent No.: US 7,611,213 B2
(45) Date of Patent: Nov. 3, 2009

(54) SLIDING TRACK ASSEMBLY

(75) Inventors: Sui-An Wu, Taipei (TW); Chih-Hao Yu, Taipei (TW)

(73) Assignee: Atom International Co., Ltd., Taipei (TW)

( * ) Notice: Subject to any disclaimer, the term of this patent is extended or adjusted under 35 U.S.C. 154(b) by 395 days.

(21) Appl. No.: 11/685,224

(22) Filed: Mar. 13, 2007

(65) Prior Publication Data

US 2008/0224585 A1 Sep. 18, 2008

(51) Int. Cl.
*A47B 88/00* (2006.01)
*E05C 19/06* (2006.01)
*A47B 95/00* (2006.01)

(52) U.S. Cl. ..... 312/334.44; 292/80; 292/87; 312/333; 312/334.46

(58) Field of Classification Search ..... 312/334.44, 312/319.1, 333, 334.46, 334.47, 334.1, 334.7, 312/334.8; 292/44, 42, 194, 219, 228, 80, 292/81, 87, 88
See application file for complete search history.

(56) References Cited

U.S. PATENT DOCUMENTS 1,574,023 A * 2/1926 Crompton et al. ..... 292/24
3,061,346 A * 10/1962 Jorgensen ..... 292/17
4,549,773 A 10/1985 Papp et al.
5,551,755 A 9/1996 Lindberg
5,711,554 A * 1/1998 Brown et al. ..... 292/19
5,757,109 A 5/1998 Parvin
6,126,255 A 10/2000 Yang
6,220,683 B1 4/2001 Chu
6,224,177 B1 5/2001 Chu
6,350,001 B1 2/2002 Chu
6,390,575 B1 5/2002 Chen et al.
6,705,686 B2 3/2004 Hilbert
6,860,575 B2 3/2005 Chen et al.
6,883,884 B2 * 4/2005 Chen et al. ..... 312/333
6,957,878 B2 * 10/2005 Greenwald et al. ..... 312/334.4
6,979,065 B2 * 12/2005 Egger ..... 312/333
7,029,080 B2 * 4/2006 Barry et al. ..... 312/333
7,083,243 B2 * 8/2006 Lee ..... 312/333
7,240,977 B2 * 7/2007 He ..... 312/333
2004/0174103 A1 * 9/2004 Yang ..... 312/334.46

* cited by examiner

*Primary Examiner*—Lanna Mai
*Assistant Examiner*—Andres Gallego
(74) *Attorney, Agent, or Firm*—Chen Yoshimura LLP

(57) ABSTRACT

Sliding track assembly is provided. A sliding track assembly includes a first rail, a second rail reciprocally moved with respect to the first rail, a third rail reciprocally moved with respect to the second rail, and a latch mechanism disposed on the second rail. The first rail has a retaining block, and the third rail has a protrusion. The latch mechanism includes a pair of swing arms engaged against the retaining block. When the latch mechanism is forced by the protrusion, the pair of swing arms is swung outwardly and disengaged from the retaining block.

24 Claims, 13 Drawing Sheets

SLIDING TRACK ASSEMBLY

BACKGROUND OF THE INVENTION

1. Field of the Invention

The invention relates in general to sliding track assembly and in particular to three-stage sliding track assembly having latch mechanisms with a pair of swing arms.

2. Description of the Related Art

A conventional three-stage sliding track assembly generally comprises an outer rail, a middle rail, and an inner rail reciprocally movable along a longitudinal axis thereof. The middle rail is movably mounted between the inner rail of the outer rail. A ball bearing is usually provided to mounted between any two of the rails to facilitate reciprocal sliding thereof. Moreover, various latch mechanisms configured to mount between the rails have been disclosed for positioning or releasing the rails, such as the disclosure in U.S. Pat. No. 6,350,001.

BRIEF SUMMARY OF THE INVENTION

According to a first aspect of the present invention, a sliding track assembly is provided. The sliding track assembly includes a first rail, a second rail, a third rail, a retaining block and a protrusion. The second rail is reciprocally moved with respect to the first rail. The third rail is reciprocally moved with respect to the second rail. The latch mechanism is disposed on the second rail. The protrusion is disposed on the third rail. The latch mechanism includes a pair of swing arms engaged against the retaining block. When the latch mechanism is forced by the protrusion, the pair of swing arms is swung outwardly and is disengaged from the retaining block.

According to a second aspect of the present invention, a sliding track assembly is provided. The sliding track assembly comprises a first rail, a second rail and a third rail. The first rail includes a block. The second rail is moved with respect to the first rail. The second rail includes a latch mechanism having a pair of arms engaged against the block when the second rail is in a first position. The third rail is moved with respect to the second rail. The third rail includes a protrusion at an end thereof. When the protrusion forces the latch mechanism to expand a gap between the pair of arms, the pair of arms is disengaged from the block, and the second rail is moved from the first position to a second position with the block passing the gap.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
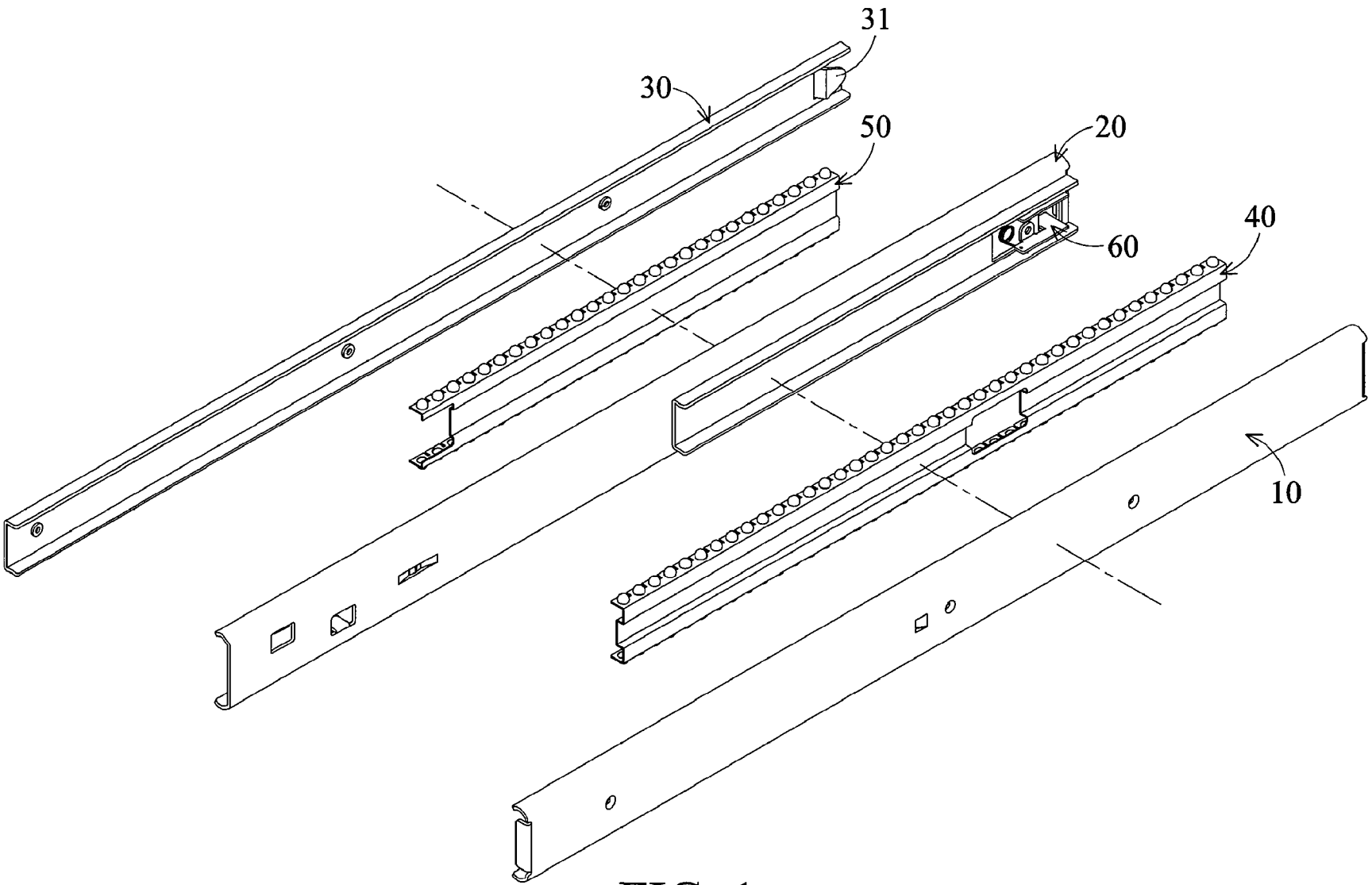
FIG. 1 is an exploded diagram of a three-stage sliding track assembly according to a first embodiment of the invention.

Referring to FIG. 1, a first embodiment of a three-stage sliding track assembly primarily comprises a first rail 10, a second rail 20, a third rail 30, two sliding bearings 40 and 50, and a latch mechanism 60. In this embodiment, the sliding bearing 40 is slidably disposed between the first rail 10 and the second rail 20. The sliding bearing 50 is slidably disposed between the second rail 20 and the third rail 30, facilitating reciprocal sliding of the first rail 10, the second rail 20, and the third rail 30.

Figure 2:
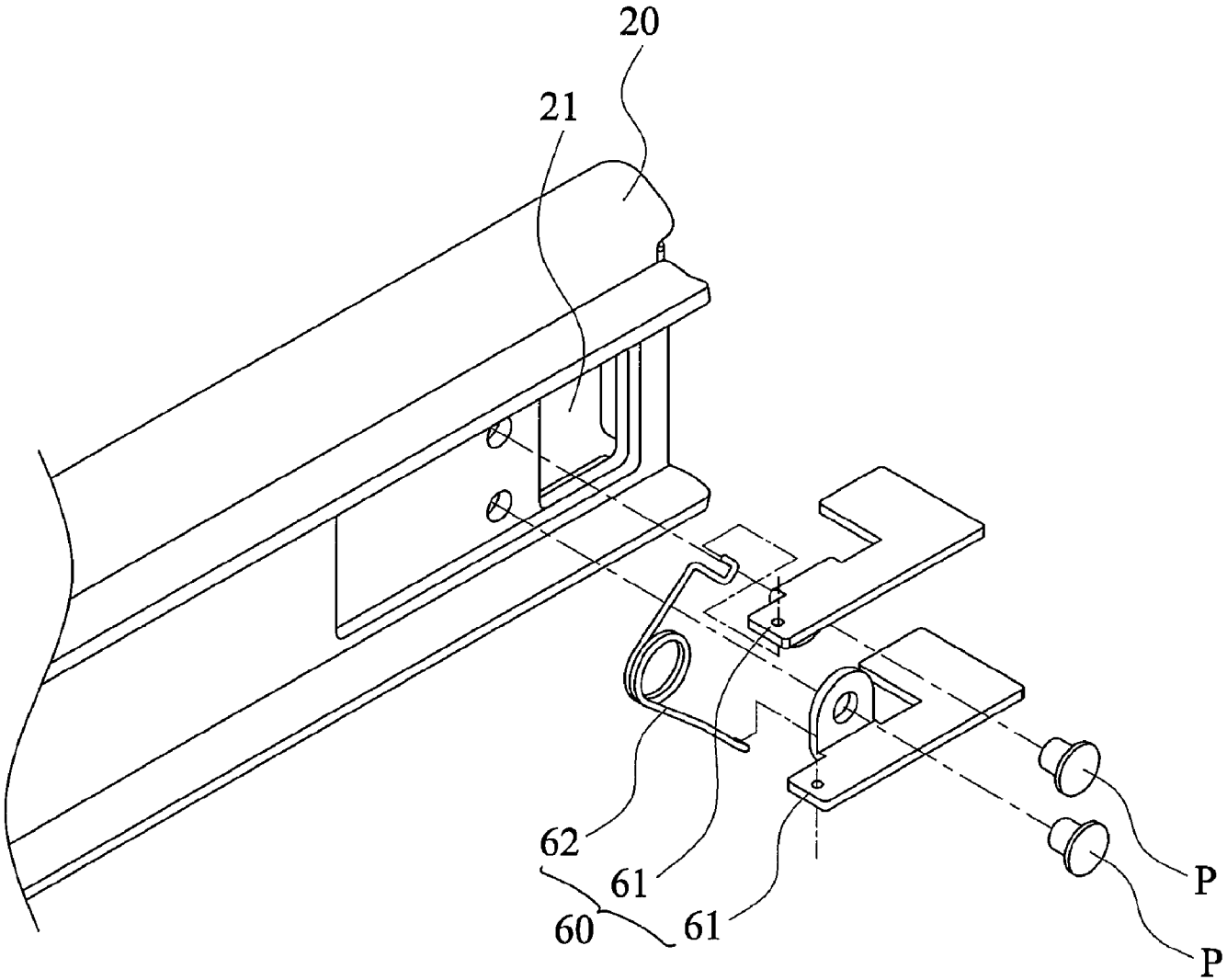
FIG. 2 is an exploded diagram of a latch mechanism connected to a second rail.

As shown in FIG. 2, the latch mechanism 60 is disposed on or connected to the second rail 20. The latch mechanism 60 includes a pair of swing arms 61 and an elastic means 62 for connecting the pair of two arms 61. For Example, the elastic means 62 is connected to two first ends of the pair of swing arms 61. Here, the pair of swing arms 61 is rotatably pivoted to the second rail 20 by pivots P and penetrate through a hole 21 of the second rail 20. For example, two second ends of the pair of swing arms 61 penetrate through the hole 21. Two pivot portions of the pair of swing arms 61 hinged by pivots P are configured to dispose between the two first ends and the second ends. In some embodiments, the elastic means 62 can be a torsion spring, a flexible clip or combination threreof. For example, the pair of the swing arms 61 is L-shaped.

Figure 3A:
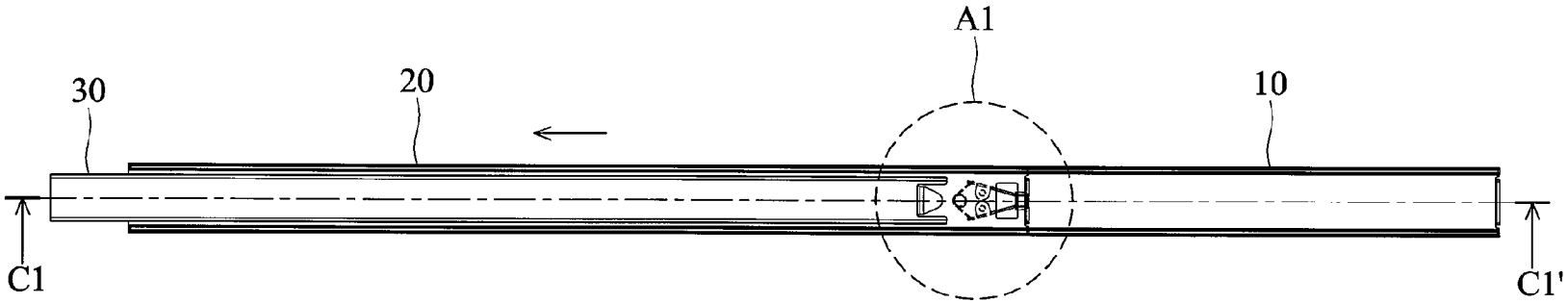
FIG. 3A is a top view of a sliding track assembly having a pair of swing arms engaged against a retaining block.
Figure 3B:
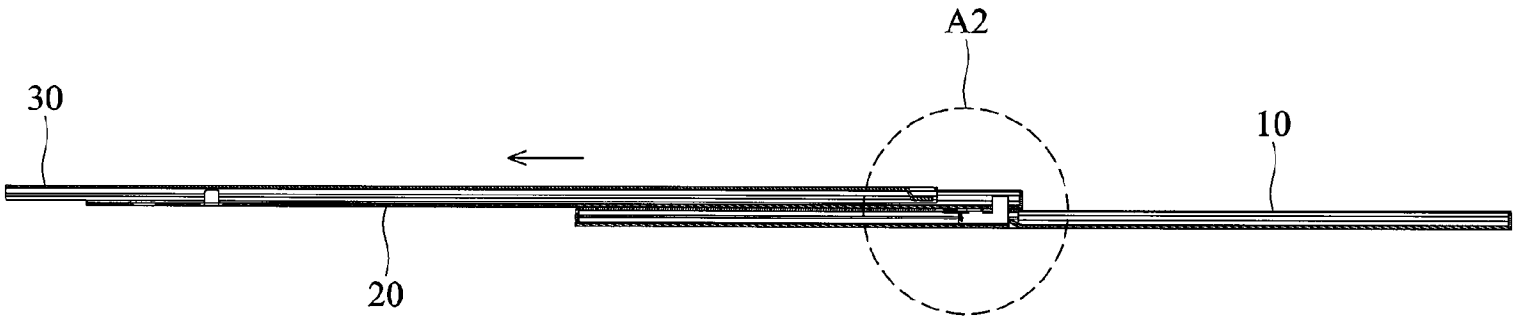
FIG. 3B is a sectional view of the sliding track assembly along C1-C1' in FIG. 3A.
Figure 3C:
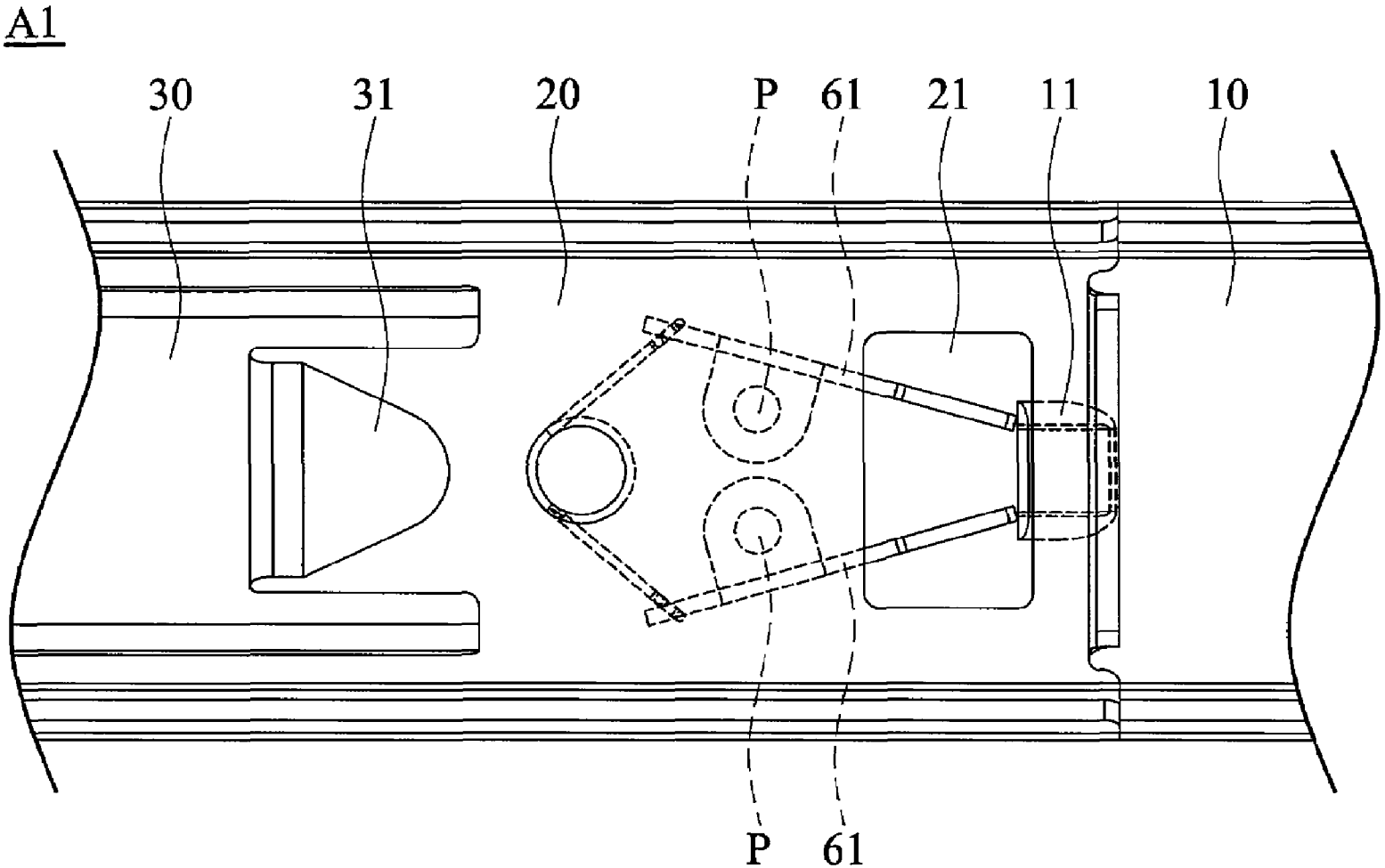
FIG. 3C is a large view of portion A1 in FIG. 3A.
Figure 3D:
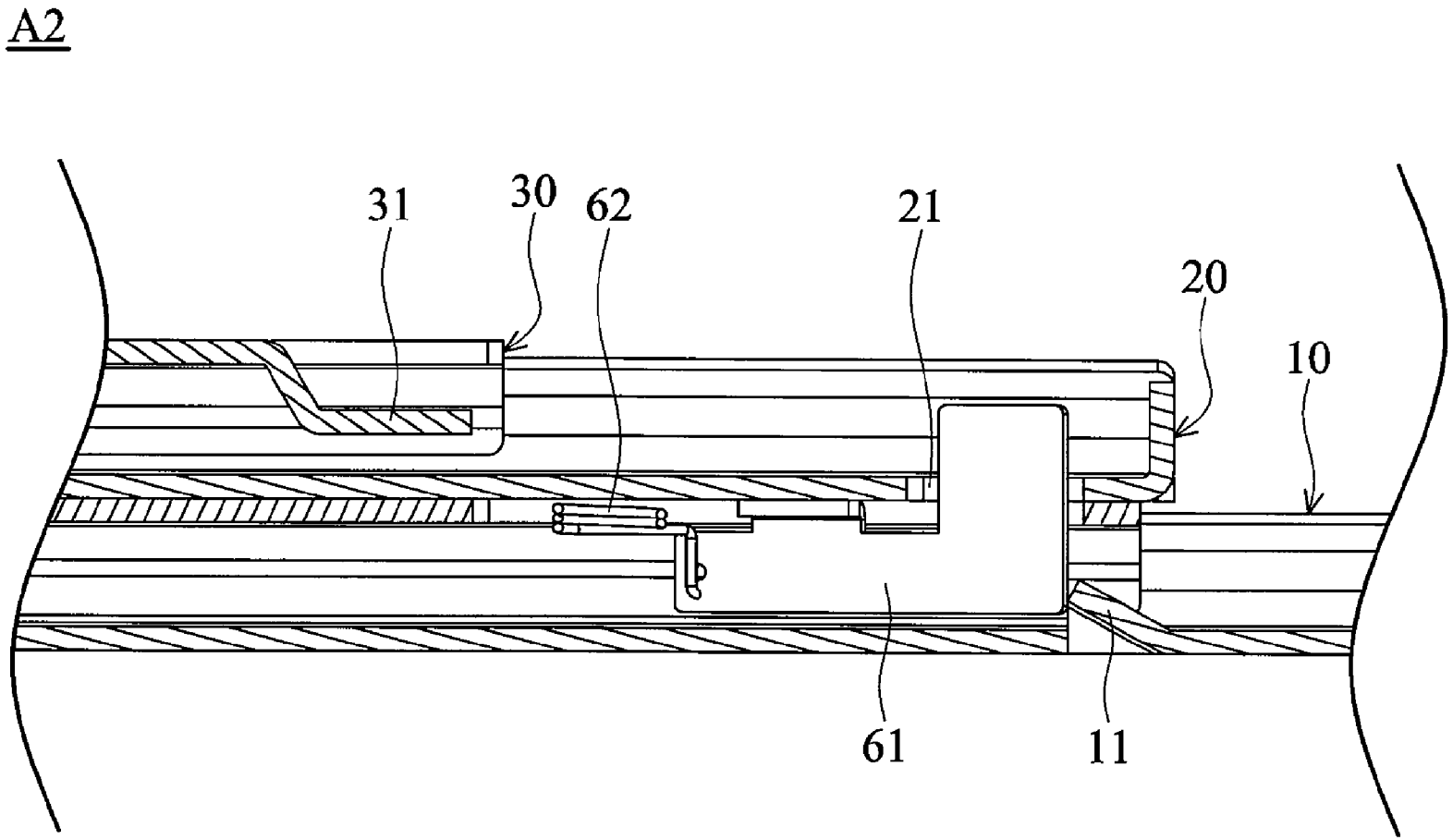
FIG. 3D is a large view of portion A2 in FIG. 3B.
Figure 4A:
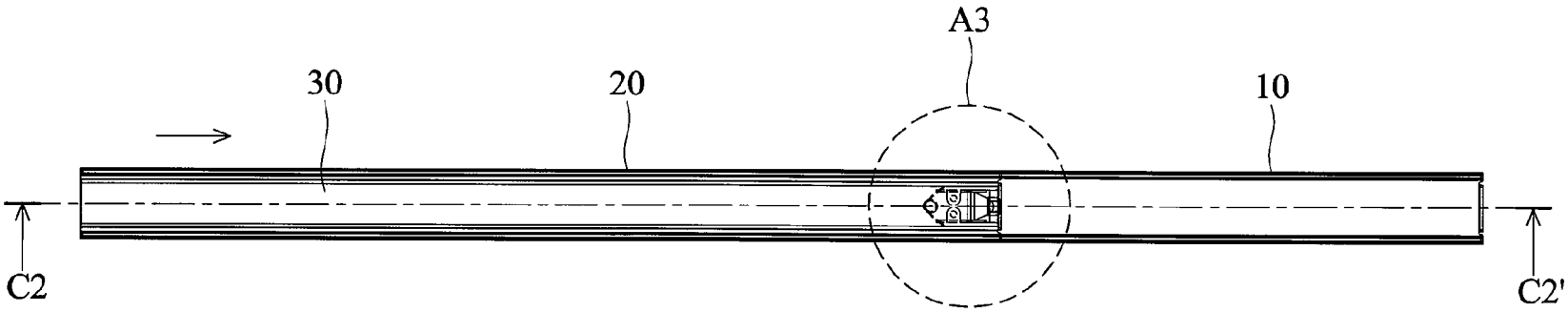
FIG. 4A is a top view of a sliding track assembly when a pair of swing arms are disengaged from a retaining block.
Figure 4B:
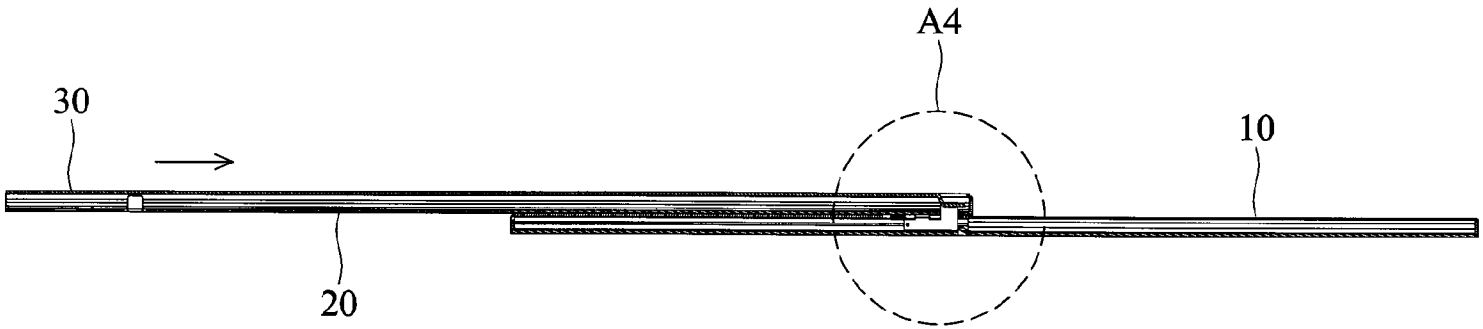
FIG. 4B is a sectional view of the sliding track assembly along C2-C2' in FIG. 4A.
Figure 4C:
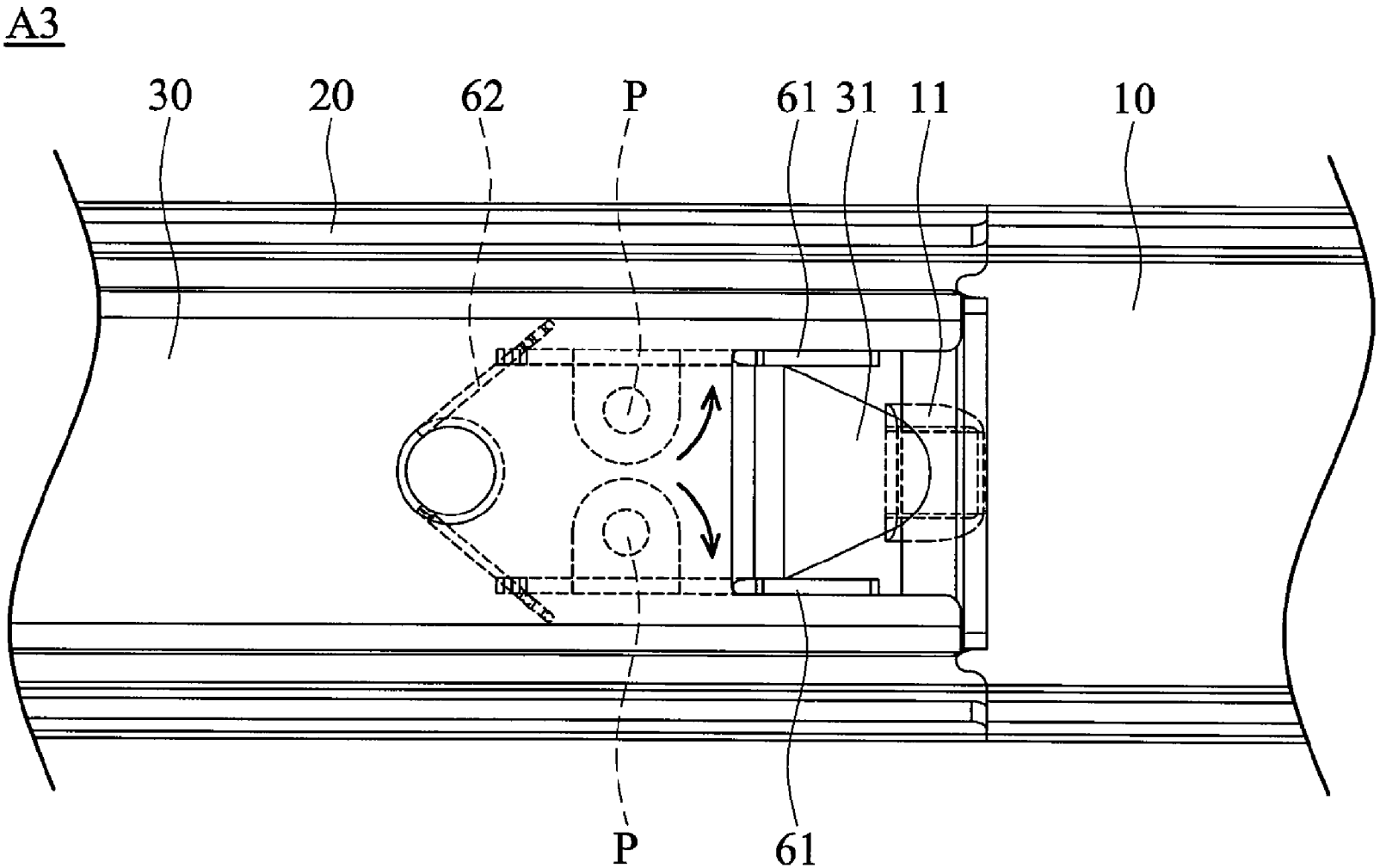
FIG. 4C is a large view of portion A3 in FIG. 4A.
Figure 4D:
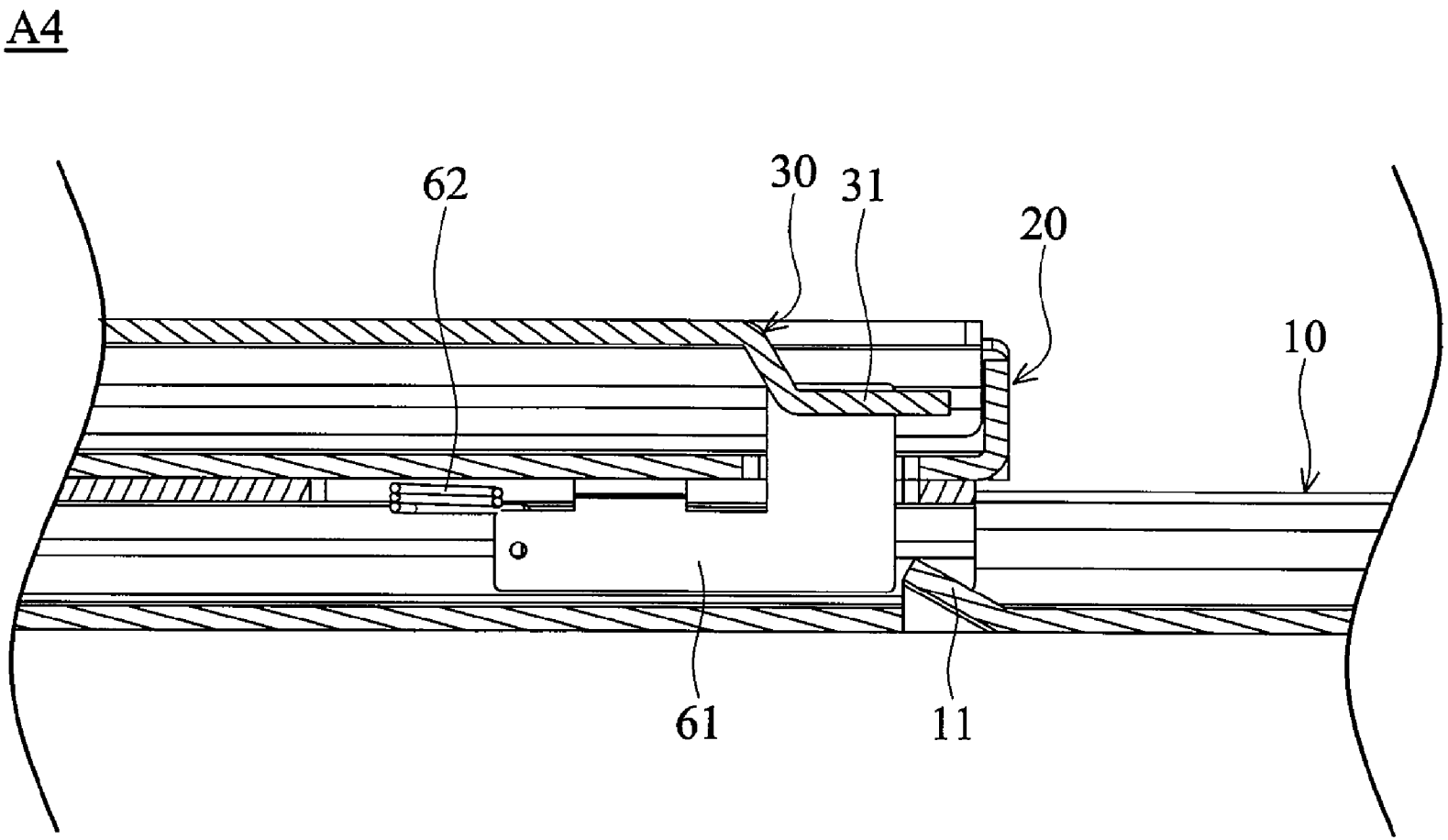
FIG. 4D is a large view of portion A4 in FIG. 4B.

Referring to FIGS. 3A-3D, when the sliding track assembly is extended from a collapsed state, the second rail 20 slides leftward to a first position with respect to the first rail 10, such that the pair of swing arms 61 is engaged against a retaining block 11 disposed on the first rail 10, as shown in FIGS. 3C and 3D. For example, bottoms of the two second ends of the pair of swing arms 61 are retained or blocked by the retaining block 11. Particularly, the pair of swing arms 61 forms a tapered structure by spring force from the elastic means 62 and is engaged against the retaining block 11, to latch and retain the second rail 20 in the first position.

Referring to FIGS. 4A-4D, when the second rail 20 is released from the first position, the third rail 30 is moved rightward along the second rail 20. A protrusion 31 disposed at one end of the third rail 30 forces the pair of swing arms 61 to swing outwardly around the pivots P, as the arrows indicate in FIG. 4C. For example, tops of the two second ends of the pair of swing arms 61 are forced or pushed by the protrusion 31. Hence, the gap between the pair of swing arms 61 is expanded, such that the pair of swing arms 61 is disengaged from the retaining block 11. For example, the gap between tops of the second ends of the pair of swing arms 61 is expanded, bottoms of the two second ends of the pair of swing arms 61 are released from the retaining block 11.

Figure 5A:
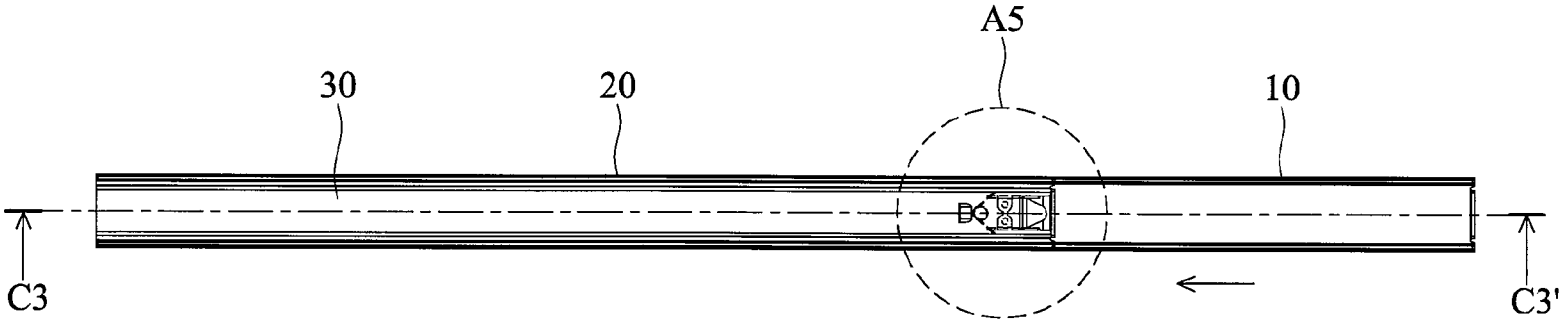
FIG. 5A is a top view of a sliding track assembly when a first rail slides leftward relative to a second rail.
Figure 5B:
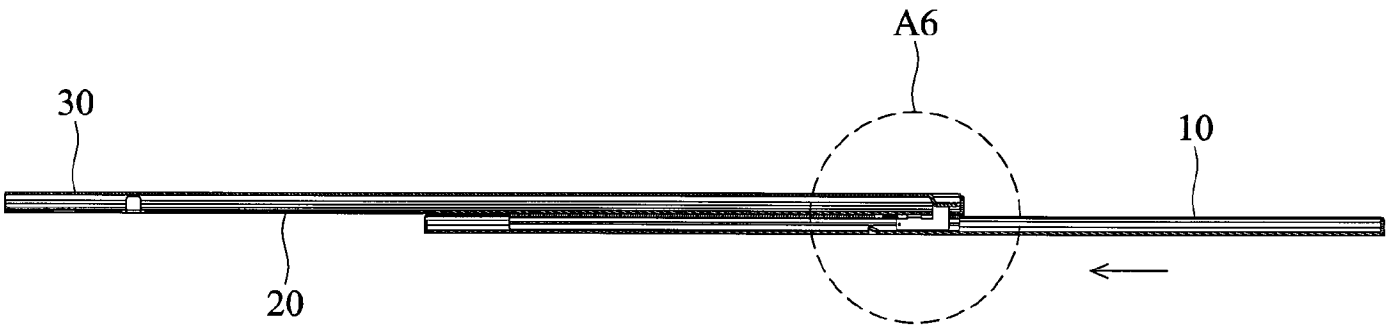
FIG. 5B is a sectional view of the sliding track assembly along C3-C3' in FIG. 4A.
Figure 5C:
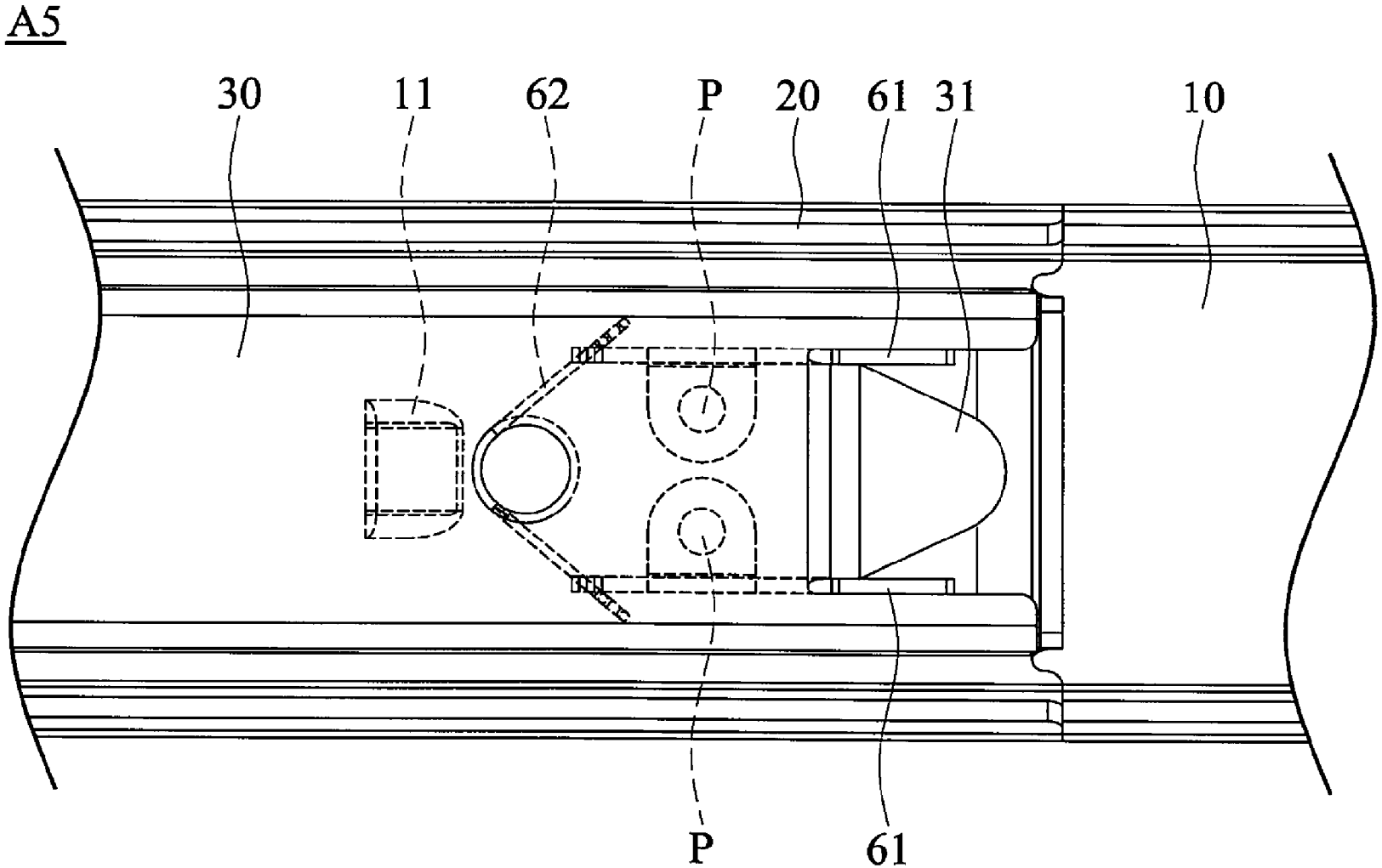
FIG. 5C is a large view of portion A5 in FIG. 5A.
Figure 5D:
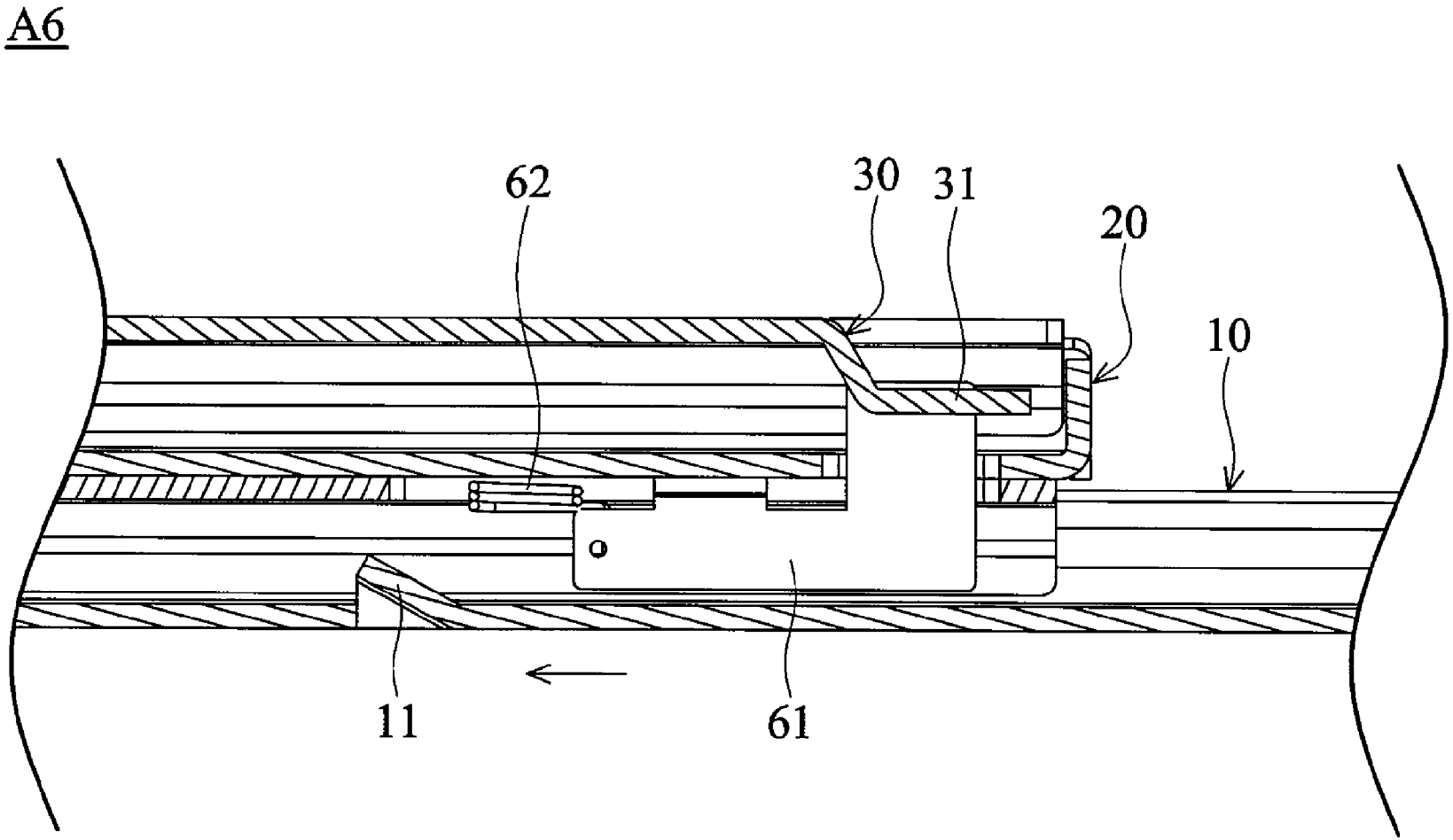
FIG. 5D is a large view of portion A6 in FIG. 5B.

Referring to FIGS. 5A-5D, when the pair of swing arms 61 is disengaged from the retaining block 11, the first rail 10 and the second rail 20 are horizontally movable with respect to each other. As shown in FIGS. 5C and 5D, the first rail 10 slides leftward relative to the second rail 20 with the retaining block 11 passing through the expanded gap between the pair of swing arms 61 (i.e. the second rail 20 slides rightward relative to the first rail 10 from the first position to a second position), such that the sliding track assembly returns to the collapsed state.

Figure 6:
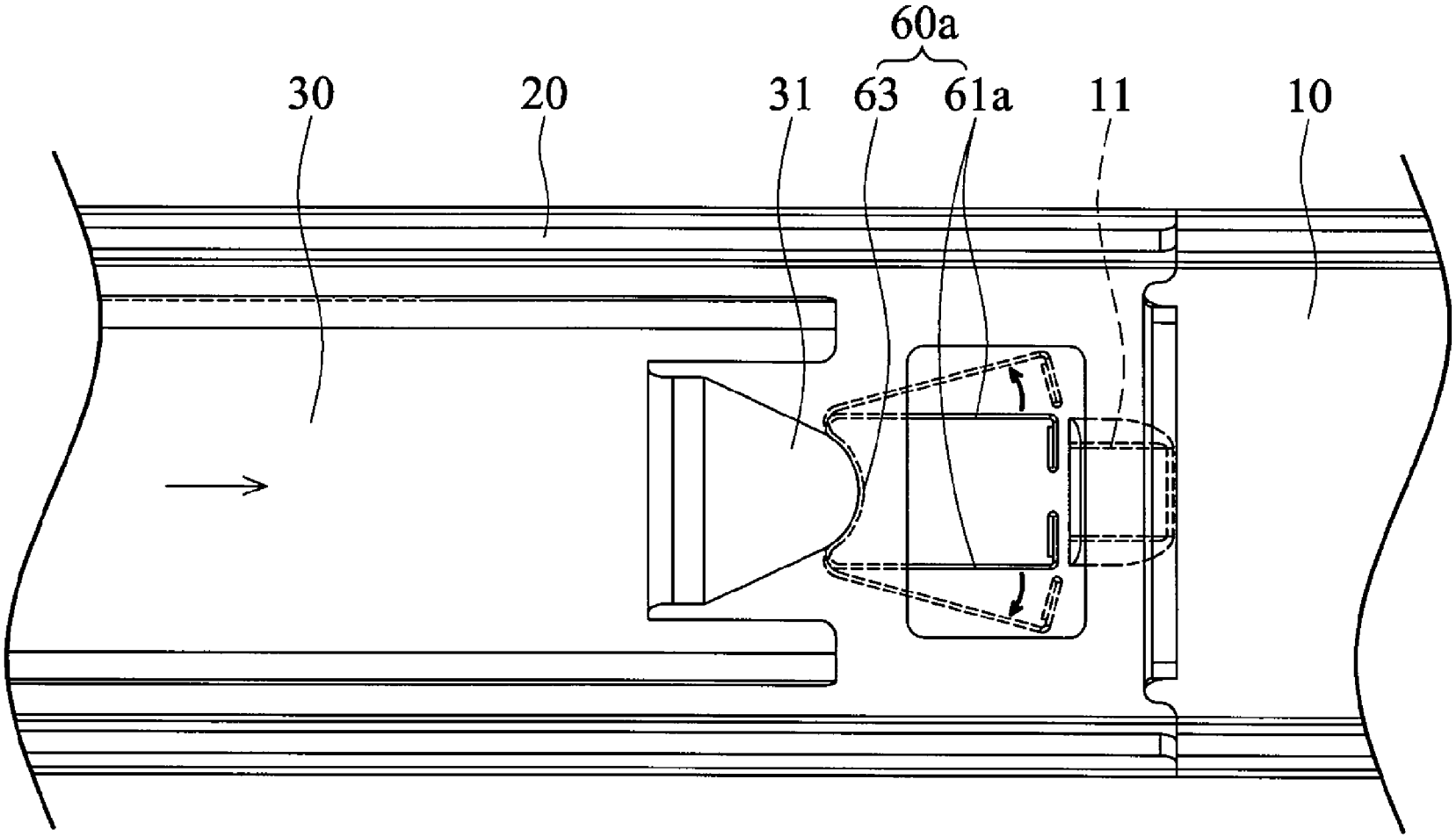
FIG. 6 is a perspective diagram of a second embodiment of a U-shaped latch mechanism having a curved contact portion.

Referring to FIG. 6, a second embodiment of the latch mechanism 60*a* comprises a pair of swing arms 61*a* and a curved flexible contact portion 63 for connecting the pair of swing arms 61*a*. In some embodiments, the latch mechanism 60 may be a U-shaped elastic strip integrally formed in one piece. In other word, the flexible contact portion 63 and the pair of swing arms 61*a* are integrally formed in one piece. As shown in FIG. 6, when the third rail 30 moves rightward and pushes the contact portion 63, the pair of swing arms 61*a* is swung outwardly to expand the gap therebetween, such that the pair of swing arms 61*a* is disengaged from the retaining block 11.

Figure 7:
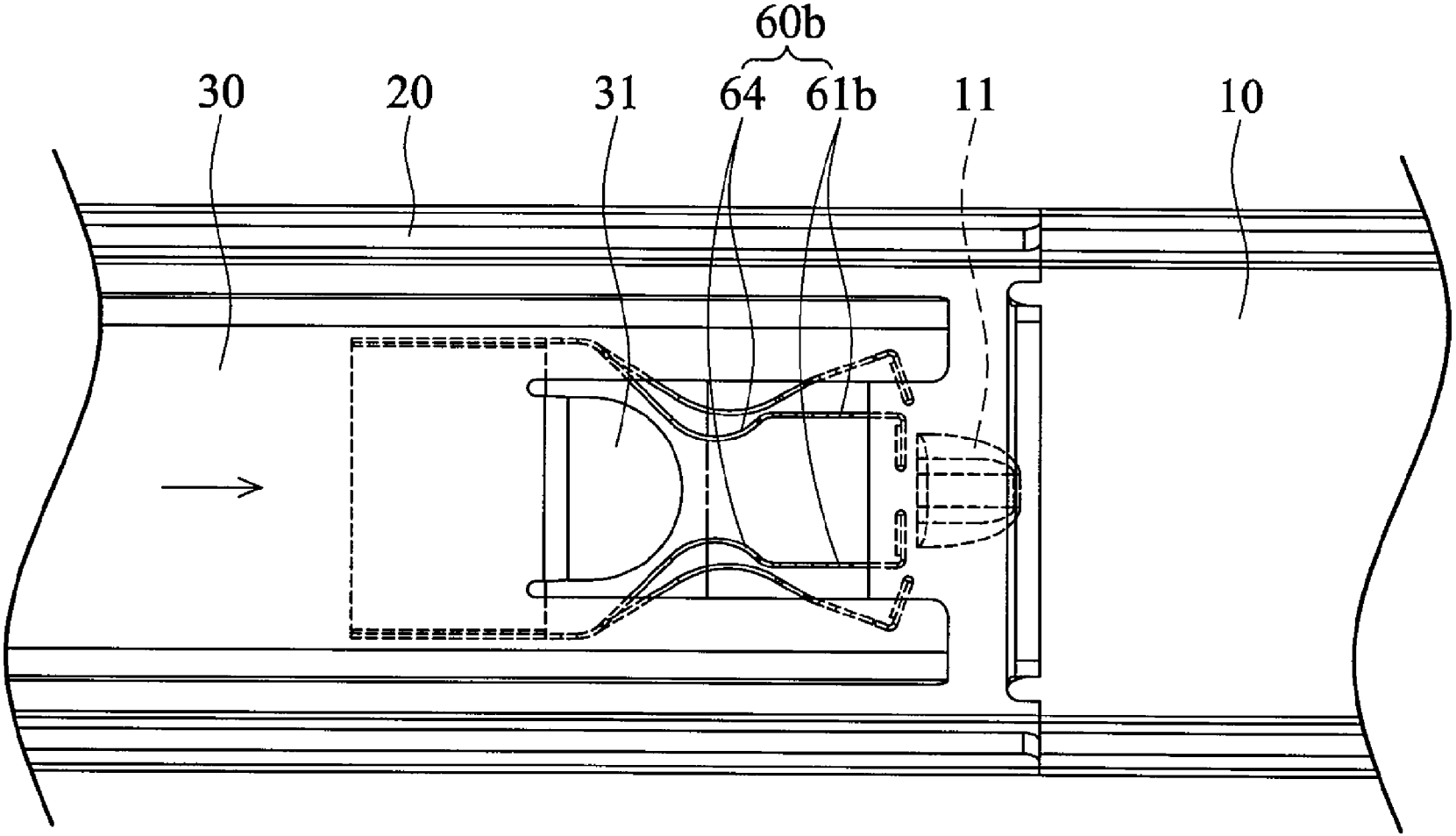
FIG. 7 is a perspective diagram of a third embodiment of a U-shaped latch mechanism having a pair of funnel-shaped contact portions.

As shown in FIG. 7, a third embodiment of the latch mechanism 60*b* comprises a pair of swing arms 61*b* and two funnel-shaped contact portions 64 respectively formed therein. In this embodiment, the latch mechanism 60*b* is a U-shaped elastic strip integrally formed in one piece. In other word, the pair of funnel-shaped contact portions 64 and the pair of swing arms 61*b* are integrally formed in one piece. As shown in FIG. 7, when the third rail 30 moves rightward and presses the funnel-shaped contact portions 63, the pair of swing arms 61*b* is swung outwardly to expand the gap therebetween, such that the pair of swing arms 61*b* are disengaged from the retaining block 11.

Three-stage sliding track assembles are provided according to the embodiments. The sliding track assembly comprises a latch mechanism having a pair of swing arms separably engaged against a retaining block of a sliding rail, facilitating easy assembly and convenience of usage.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A sliding track assembly, comprising:

a first rail;

a retaining block disposed on the first rail;

a second rail reciprocally moved with respect to the first rail;

a third rail reciprocally moved with respect to the second rail;

a latch mechanism disposed on the second rail, wherein the latch mechanism includes a pair of swing arms engaged against the retaining block when the second rail is in a first position; and a protrusion disposed on the third rail, wherein when the third rail is moved relative to the second rail and the protrusion forcibly engages the latch mechanism, the pair of swing arms is swung outwardly and disengaged from the retaining block.

2. The sliding track assembly as claimed in claim 1, wherein the second rail includes a hole with the pair of swing arms penetrating therethrough.

3. The sliding track assembly as claimed in claim 1, wherein the pair of swing arms is L-shaped.

4. The sliding track assembly as claimed in claim 1, wherein the pair of swing arms pivotally is connected to the second rail.

5. The sliding track assembly as claimed in claim 1, wherein the latch mechanism further includes an elastic means connecting the pair of swing arms, wherein the elastic means forces the pair of swing arms to engage against the retaining block.

6. The sliding track assembly as claimed in claim 5, wherein the elastic means comprises a spring, a clip or combination thereof.

7. The sliding track assembly as claimed in claim 1, wherein the latch mechanism is a U-shaped elastic strip.

8. The sliding track assembly as claimed in claim 1, the latch mechanism further including a flexible contact portion connecting the pair of swing arms, wherein the protrusion forces the flexible contact portion to swing the pair of swing arms.

9. The sliding track assembly as claimed in claim 8, wherein the flexible contact portion is curved.

10. The sliding track assembly as claimed in claim 8, wherein the flexible contact portion and the pair of swing arms are integrally formed in one piece.

11. The sliding track assembly as claimed in claim 1, the latch mechanism further including a pair of funnel-shaped contact portions formed in the pair of swing arms, wherein the protrusion forces the pair of funnel-shaped contact portions to swing the pair of swing arms.

12. The sliding track assembly as claimed in claim 11, wherein the pair of funnel-shaped contact portions and the pair of swing arms are integrally formed in one piece.

13. The sliding track assembly as claimed in claim 1, further comprising a sliding bearing slidably disposed between the first and second rails.

14. The sliding track assembly as claimed in claim 1, further comprising a sliding bearing slidably disposed between the second and third rails.

15. A sliding track assembly, comprising:

a first rail including a block;

a second rail moved with respect to the first rail, wherein the second rail includes a latch mechanism having a pair of arms engaged against the block when the second rail is in a first position; and a third rail moved with respect to the second rail, wherein the third rail includes a protrusion at an end thereof, and when the third rail is moved with respect to the second rail the protrusion forcibly engages the latch mechanism to expand a gap between the pair of arms, the pair of arms is disengaged from the block, and the second rail is moved from the first position to a second position with the block passing the gap.

16. The sliding track assembly as claimed in claim 15, wherein the second rail includes a hole with the pair of arms penetrating therethrough.

17. The sliding track assembly as claimed in claim 16, wherein the pair of arms is pivotally connected to the second rail.

18. The sliding track assembly as claimed in claim 17, wherein the latch mechanism further includes an elastic means connecting the pair of arms, wherein the elastic means forces the pair of arms to engage against the block.

19. The sliding track assembly as claimed in claim 15, the latch mechanism further including a flexible contact portion connecting the pair of arms, wherein the protrusion forces the flexible contact portion to swing the pair of arms.

20. The sliding track assembly as claimed in claim 19, wherein the flexible contact portion and the pair of arms are integrally formed in one piece.

21. The sliding track assembly as claimed in claim 15, the latch mechanism further including a pair of funnel-shaped contact portions formed in the pair of arms, wherein the protrusion forces the pair of funnel-shaped contact portions to swing the pair of arms.

22. The sliding track assembly as claimed in claim 21, wherein the pair of funnel-shaped contact portions and the pair of arms are integrally formed in one piece.

23. The sliding track assembly as claimed in claim 15, further comprising a sliding bearing slidably disposed between the first and second rails.

24. The sliding track assembly as claimed in claim 15, further comprising a sliding bearing slidably disposed between the second and third rails.

* * * * *